US005238139A

United States Patent [19]

Bisceglia

[11] Patent Number: 5,238,139

[45] Date of Patent: Aug. 24, 1993

[54] ADJUSTABLE MULTIPLE RECYCLING RECEPTACLE RETAINING APPARATUS

[76] Inventor: Robert D. Bisceglia, 120 Millbury Ave., Millbury, Mass. 01527

[21] Appl. No.: 713,813

[22] Filed: Jun. 12, 1991

[51] Int. Cl.[5] ..... B65F 1/06

[52] U.S. Cl. ..... 220/404; 220/908; 220/909; 248/101

[58] Field of Search ..... 220/404, 909, 908; 248/99, 101

[56] References Cited

U.S. PATENT DOCUMENTS

| | | | |
|---|---|---|---|
| 1,665,724 | 4/1928 | Way | 248/101 |
| 2,363,699 | 11/1944 | Smith | 220/908 |
| 4,282,911 | 8/1981 | Sumitomo | 248/99 |
| 4,721,317 | 1/1988 | Avot | 248/101 |
| 4,750,638 | 6/1988 | Sosower | 220/909 |
| 4,834,262 | 5/1989 | Reed | 220/404 |
| 4,874,111 | 10/1989 | Heller | 220/404 |
| 4,913,308 | 4/1990 | Culbertson | 220/404 |
| 4,934,637 | 6/1990 | Guerrera | 248/101 |
| 4,967,900 | 11/1990 | Gossett | 220/404 |
| 4,974,746 | 12/1990 | Dickinson | 220/404 |
| 4,979,705 | 12/1990 | Bovitz | 248/99 |
| 5,005,727 | 4/1991 | Roth | 220/404 |
| 5,058,763 | 10/1991 | Dickinson | 220/404 |
| 5,096,086 | 3/1992 | Crema | 220/404 |

*Primary Examiner*—Allan N. Shoap
*Assistant Examiner*—S. Castellano
*Attorney, Agent, or Firm*—James F. Baird

[57] ABSTRACT

The disclosed apparatus supports and secures a plurality of trash liner like bags in a trash receptacle like receptacle. The apparatus allows, by the use of splines, that each bag be secured and removed independently of the remaining bags. Splines are used either secured to the four member support frame and cross members or incorporated into each bag. The four member support frame and cross members may be presized to a specific receptacle or adjustable to be used with a variety of receptacles. The cross members are moveable in order to allow an appropriate cross sectional area and resulting volume for each bag. The four member frame, cross members and splines may be in kit form that could be assembled by the purchaser. The apparatus may be used for sorting a variety of materials including but not exclusively trash for recycling.

2 Claims, 2 Drawing Sheets

ADJUSTABLE MULTIPLE RECYCLING RECEPTACLE RETAINING APPARATUS

BACKGROUND OF THE INVENTION

My invention relates to the field of waste receptacles. But more specifically to compartmented receptacles with a means to secure a plurality of trash liners.

As a result of the growing solid waste problems alternatives to the means of disposal are increasingly becoming inviable. Our landfills are running out of room; incinerators produce toxic air pollutants and toxic ash; and the skyrocketing costs of both options have strapped already tight local government budgets.

There is general agreement that reducing the amount of recyclable trash that is introduced into the waste stream is a common sense answer to this crisis. However, there are reasons why the recycling option is slow to catch on.

One reason is resistance to change. Many people feel it is a good idea to recycle but are not willing to make fundamental changes in their waste management practices. In order for a community recycling program to be successful, the participating residents must separate their trash before they bring it to a collection center. There are products available which aid in doing this, but many present their own problems. These include containers that have means of supporting separate trash liners but secure the liner with clips. Unfortunately these clips may be misplaced or fall into the liner when it is being removed, rendering the device useless unless replacement clips are purchased. Other containers are just aesthetically unsuitable for many people to locate in a convenient place in their home. Because of poor design, the container may be too large to put anywhere readily accessible. All these factors may make or break someone's decision to get involved in a recycling program.

PRIOR ART

U.S. Pat. No. 4,750,638—shows a device which supports two liners within a single container. It states that "each liner can be removed independent of the other", but fails to address the problem of the liner bulging at the bottom when it fills with trash making the bottom portion larger than the mouth requiring the upper portion of the container to be adjustable without removing it from the lower portion of the container removing full liners would be cumbersome and frustrating. Also, clips are being used which are very easy to lose.

U.S. Pat. No. 4,874,111 shows a compartmented refuse container which supports multiple trash liners with a method of pins. Unfortunately, under the weight of its contents, the liner will be stressed at these points and may tear. Again, this is a method in which its components may be lost. Another problem due to the defined preformed partitions within the outer shell is the overall size of the container. If it were made too big it would not be acceptable for most residential applications. If it were to be sized for in-home use, the separate compartments would be too small for any practical use.

U.S. Pat. No. 4,834,262 shows a container with a similar practical size problem but also the dilemma of securing two liners with a common retainer arises. It is very clumsy to have to interfere with the support of one bag in order to remove another. When separating trash, it is common for one category of trash to fill a bag faster or slower than another. Therefore each bag should be completely independant from other bags in terms of removal.

SUMMARY OF THE INVENTION

The apparatus disclosed in detail below is of a form that is both practical and economical in order to promote wide use. In addition to its preferred form, it may be made in an adjustable variation or in a kit form. It comprises four frame members (two parallel frame members and two perpendicular frame members) attached to each other by any of several means well known in the industry such as screws, adhesive or heat melt process, forming a rectangular shaped frame, a plurality of cross members and a plurality of compressible splines. The frame members are formed to fit within and be secured frictionally at the top opening of a trash recepticle like receptacle. The frame members and cross members may be molded plastic. The two parallel frame members have a groove along their inner facing surfaces. These grooves serve to receive the compressible splines. The two perpendicular frame members have a channel along their inner facing surfaces. The cross members are formed to have smaller button like ends sized to fit within but be retained by the channels in the perpendicular frame members. The cross members ends are able to slide sideways within the channels and once positioned may be secured in place by a screw or similar means. The cross members also have grooves along both of their side surfaces. These grooves serve the same purpose as the grooves in the parallel frame members, that being to receive the compressed splines. The splines are made of resilient material in order that they will compress upon frictional contact with the grooves. The splines are attached at one end in the grooves, by means such as friction, in order that one spline is attached by one of its ends near the inner side end of each of the parallel frame members and also with one near the end of the inner side end of each cross member. The splines are compressible in order that they will secure, by friction, the opening edge of trash liner like bags in the grooves. The splines have an enlarged end in the form of a tab for ease of removal. The resulting configuration allows the cross members to be moved to a plurality of positions making it possible to devote a large cross sectional area and resulting volume to bags receiving a high volume of material and smaller cross sectional area and resulting volume to bags receiving a low volume of material.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENTS

Figure 1:
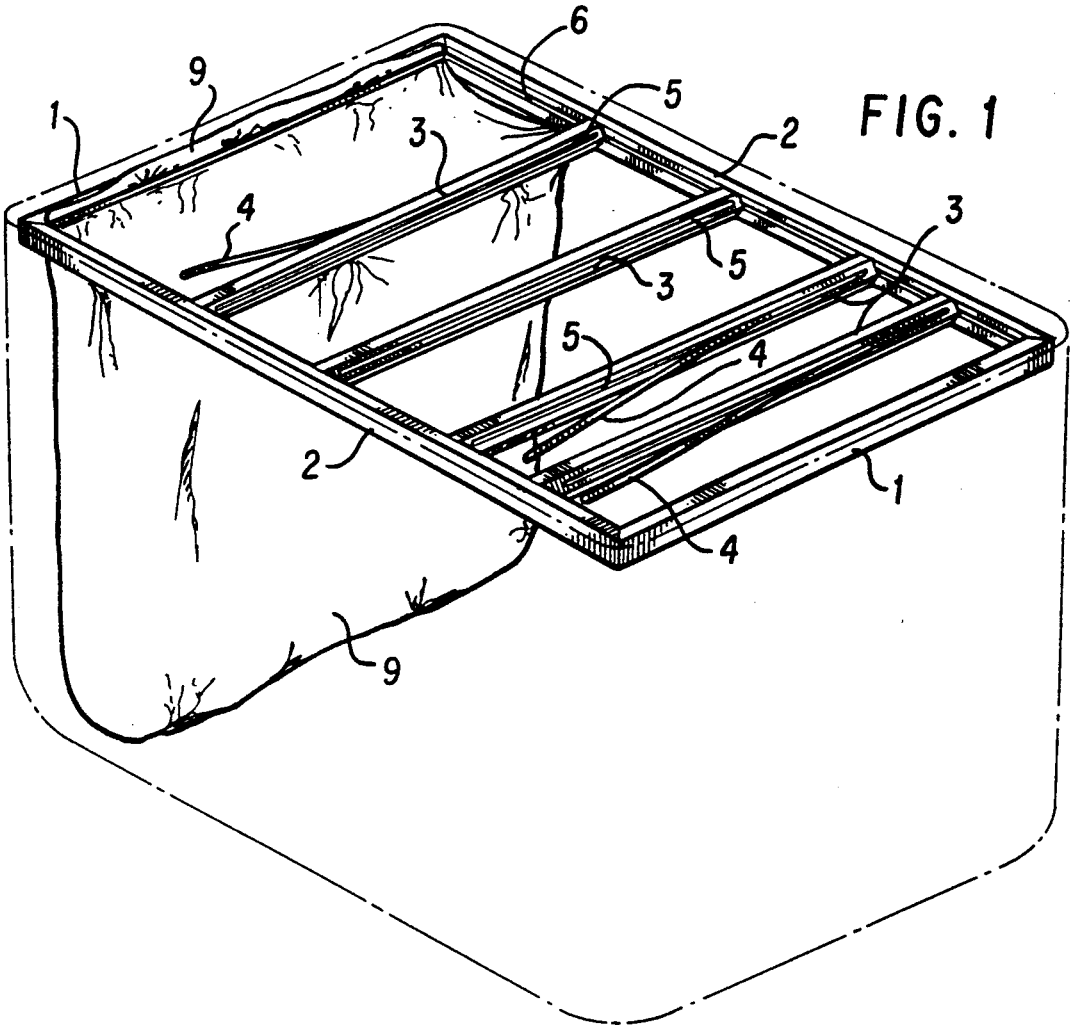
FIG. 1 illustrates a top perspective view of the apparatus indicating one bag being suspended, dotted lines indicating a receptacle.

Turning first to FIG. 1, there is shown the adjustable multiple recycling receptacle retaining apparatus of the present invention comprising four members (two parallel members (1) and two perpendicular members (2) attached to each other by means to form a rectangular shaped hoop) sized and shaped to fit within and be secured, by means, at the top opening of a trash receptacle like receptacle. Cross members (3) are secured by means to the hoop and a plurality of splines (4) are secured, by means, one at one inner side end of each of the parallel members and one at the end on the inner side of the cross members. There is a groove (5) along the inner side of the two parallel members of the hoop. There is also an identical groove along both inner sides of each cross member (5). There is a channel (6) along the inner facing surface of the two perpendicular members of the hoop.

Figure 2:
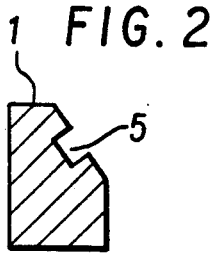
FIG. 2 illustrates an end view of a parallel frame member showing a groove.
Figure 3:
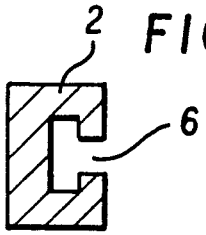
FIG. 3 illustrates an end view of a perpendicular frame member showing a channel.
Figure 4:
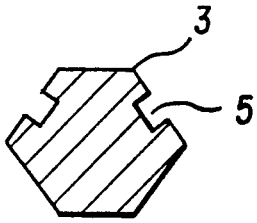
FIG. 4 illustrates an end view of a cross member showing two grooves.
Figure 5:
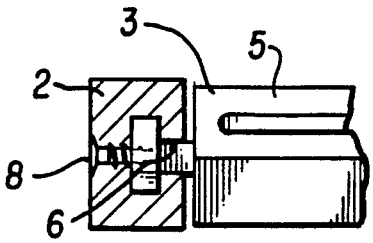
FIG. 5 illustrates an end view of a perpendicular frame member and side view of a cross member showing the button like end within the channel.
Figure 6:
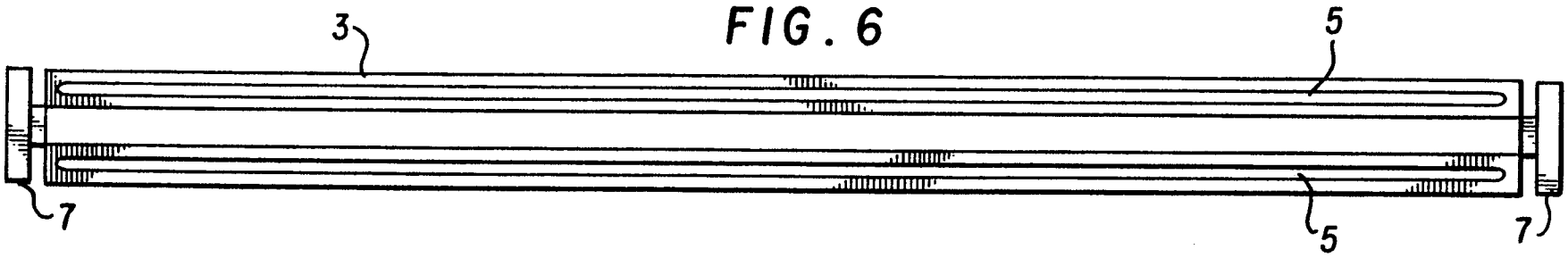
FIG. 6 illustrates a top view of a cross member showing two grooves and both button like ends.
Figure 7:
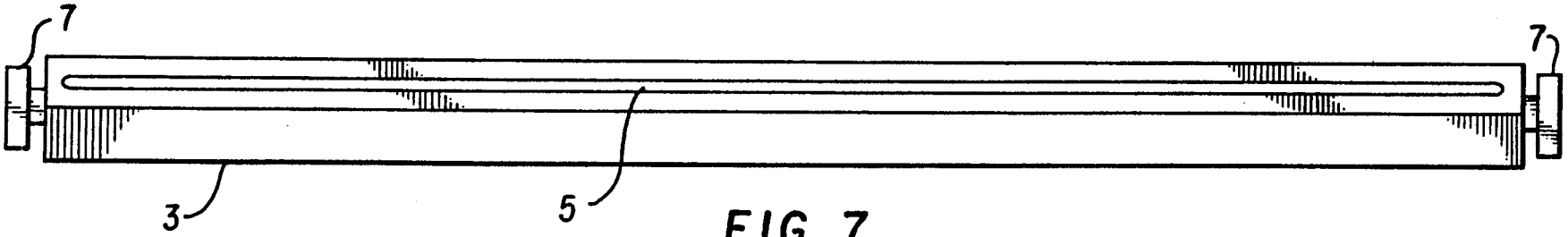
FIG. 7 illustrates a side view of a cross member showing one groove and both button like ends.

The grooves in the parallel frame member and cross member are further illustrated in FIG. 2 and FIG. 4. The channel in the perpendicular frame member is illustrated in FIG. 3. The ends of the cross members may be secured at the desired location by means such as a screw (8) as illustrated in FIG. 5. The ends of the cross members (7) as illustrated in FIG. 6 and FIG. 7 are sized and shaped in order that the ends slideably fit within and are retained by the channel (6). The spline (4) secured to the cross member (3) must be compressed slightly in order to fit within the grooves (5) thereby securing a trash liner like bag (9) as shown as illustrated in FIG. 1. The splines (4) secured to the ends of two parallel frame members of the hoop (1) must be compressed slightly in order to fit within the grooves (5).

From the foregoing description it will be apparent that modifications can be made to the apparatus without departing from the teaching of the present invention. Accordingly, it is distinctly understood that the invention is not limited to the preferred embodiment but may be embodied and practiced within the scope of the following claims.

What is claimed is:

1. Apparatus for supporting a plurality of trash bags at the rim of a trash receptacle in order that the bags may be suspended at the receiving end of each bag and each bag may be removed independently of the other bags and may have a variety of cross sectional areas, and resulting volumes devoted to each bag, said apparatus comprising:

a rectangular hoop, shaped and sized to test within, and be frictionally secured, at the top opening of the receptacle, said hoop having two pairs of parallel sides, one pair forming the latitudinal sides and one pair forming the longitudinal sides, said hoop having a groove on the inward and upward facing surface of the latitudinal sides and a channel on the inward facing surface of the longitudinal sides;

a plurality of cross members each having smaller sized ends protruding to fit slideably within the channels of the longitudinal sides of the said hoop, and be secured to said hoop, and said cross members having a hexagonal cross section and having grooves along both inner and upward facing planar surfaces;

and a plurality of compressible splines made of compressible material, sized to be frictionally held within said grooves when in said compressed state, said splines having a first end and a second end, the first end being secured in said grooves upon compression by frictional contact, one at each of the two latitudinal sides of the hoop and one to each side of each cross member, said splines securing the plurality of bags to the hoop and cross members by frictional contact when compressed and inserted into said grooves, the second end being formed and shaped into an enlarged tab.

2. An apparatus having a trash receptacle and a plurality of trash bags supported at the rim of the trash receptacle in order that the bags may be suspended at the receiving end of each bag and each bag may be removed independently of the other bags and may have a variety of cross sectional areas, and resulting volumes devoted to each bag, said apparatus comprising:

a rectangular hoop, shaped and sized to rest within, and be frictionally secured, at the top opening of the receptacle, said hoop having two pairs of parallel sides, one pair forming the latitudinal sides and one pair forming the longitudinal sides, said hoop having a groove on the inward and upward facing surface of the latitudinal sides and a channel on the inward facing surface of the longitudinal sides;

a plurality of cross members each having smaller sized ends protruding to fit slideably within the channels of the longitudinal sides of the said hoop, and be secured to said hoop, and said cross members having a hexagonal cross section and having grooves along both inner and upward facing planar surfaces;

a plurality of compressible splines made of compressible material, sized to be frictionally held within said grooves when in said compressed state, said splines having a first end and a second end, the first end being secured in said grooves upon compression by frictional contact, one at each of the two latitudinal sides of the hoop and one to each side of each cross member, said splines securing the plurality of bags to the hoop and cross members by frictional contact when compressed and inserted into said grooves, the second end being formed and shaped into an enlarged tab.

* * * * *